US009217557B2

(12) United States Patent
Briggs

(10) Patent No.: US 9,217,557 B2
(45) Date of Patent: Dec. 22, 2015

(54) APPARATUS AND SYSTEM FOR EMITTING LIGHT USING A GRID LIGHT ENGINE

(71) Applicant: ARKALUMEN INC., Ottawa (CA)

(72) Inventor: Gerald Edward Briggs, Ottawa (CA)

(73) Assignee: ARKALUMEN INC., Ottawa (CA)

( * ) Notice: Subject to any disclaimer, the term of this patent is extended or adjusted under 35 U.S.C. 154(b) by 383 days.

(21) Appl. No.: 13/674,586

(22) Filed: Nov. 12, 2012

(65) Prior Publication Data

US 2013/0223058 A1 Aug. 29, 2013

Related U.S. Application Data

(60) Provisional application No. 61/558,914, filed on Nov. 11, 2011.

(51) Int. Cl.

| | |
|---|---|
| ***F21V 8/00*** | (2006.01) |
| ***F21V 21/005*** | (2006.01) |
| ***F21S 8/04*** | (2006.01) |
| ***H05B 33/08*** | (2006.01) |
| *F21Y 101/02* | (2006.01) |
| *F21Y 105/00* | (2006.01) |
| *F21Y 113/00* | (2006.01) |

(52) U.S. Cl.

CPC ..... *F21V 21/005* (2013.01); *F21S 8/04* (2013.01); *H05B 33/0827* (2013.01); *F21Y 2101/02* (2013.01); *F21Y 2105/003* (2013.01); *F21Y 2113/005* (2013.01)

(58) Field of Classification Search

CPC ..... F21S 4/008; F21S 8/04; F21V 21/005; H05K 1/00; H05B 33/0827; F21Y 2105/003; F21Y 2113/005; F21Y 2101/02

USPC ..... 362/612, 613, 231, 249.02, 249.06, 225

See application file for complete search history.

(56) References Cited

U.S. PATENT DOCUMENTS

| | | | | |
|---|---|---|---|---|
| 2010/0046210 | A1* | 2/2010 | Mathai et al. | 362/147 |
| 2010/0302477 | A1* | 12/2010 | Ohmi et al. | 349/62 |
| 2011/0194047 | A1* | 8/2011 | Bruyneel et al. | 349/61 |
| 2012/0320626 | A1* | 12/2012 | Quilici et al. | 362/606 |

* cited by examiner

*Primary Examiner* — Thomas M Sember

(74) *Attorney, Agent, or Firm* — Murray IP Consulting Inc.; Sean Murray

(57) ABSTRACT

Lighting apparatus may comprise elongated segments interconnected perpendicularly to form a grid light engine, each segment comprising groups of LEDs on both sides such that, when interconnected together, the grid light engine is operable to emit light inwardly to a plurality of grid squares formed by the segments. The apparatus may further comprise a back panel light engine comprising LEDs, the back panel light engine being coupled adjacent to the grid and operable to emit light from its LEDs through the grid. This architecture can allow for light from different sets of LEDs to be projected in different directions. When the different sets of LEDs emit different spectrum outputs, the light fixture can appear visually different depending upon the viewers' perspective. When the different sets of LEDs are controlled separately, visual effects such as the appearance of depth, sunrises and sunsets can be generated.

20 Claims, 19 Drawing Sheets

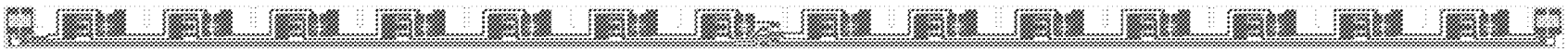
EM
EM
EM

APPARATUS AND SYSTEM FOR EMITTING LIGHT USING A GRID LIGHT ENGINE

CROSS-REFERENCE TO RELATED APPLICATION

The present application claims the benefit under 35 USC 119(e) of 5 U.S. Provisional Patent Application 61/558,914 filed on Nov. 11, 2011 and hereby incorporated by reference herein.

FIELD OF THE INVENTION

The invention relates generally to lighting and, more particularly, to apparatus and system for emitting light using a grid light engine.

BACKGROUND

Light Emitting Diodes (LEDs) are increasingly being adopted as general illumination lighting sources due to their high energy efficiency and long service life relative to traditional sources of light such as incandescent, fluorescent and halogen. Each generation of LEDs are providing improvements in energy efficiency and cost per lumen, thus allowing for lighting manufacturers to produce LED light fixtures at increasingly cost competitive prices. These reduced costs are expanding the applications of LED lighting from niche markets, such as outdoor street lighting, Christmas lights and flashlights, to general illumination within offices, retail, industrial, and residential environments.

LEDs that are utilized in general illumination applications typically are white LEDs composed of blue LEDs with a yellow phosphor coating. These white LEDs appear white to the human eye and can be manufactured at various color temperatures. Although these white LEDs can provide sufficiently high quality "white" light for many applications, they do not provide a full spectrum of light similar to sunlight.

To address this, in some implementations, LED light fixtures are utilizing RGB (red, blue, green) or RGBA (red, blue, green, amber) LED modules that allow for a mixture of limited spectrum LEDs focused on particular color spectrums to be mixed to create white light. The use of RGB and RGBA LED modules allows control over the color of the LED fixture and can enable an improved full spectrum "white" light to be projected when the correct balance of red, blue, green and amber LEDs are utilized. In some cases, both white LEDs and RGB/RGBA LED modules are utilized in the same fixture. The mixing of the light spectrum from the white LEDs and the RGB/RBGA modules can increase the CRI (Color Rending Index) for the fixture relative to a fixture only using standard white LEDs. This increase in CRI can also occur if the fixture simply includes white LEDs with some red and/or green LEDs properly balanced.

Despite the addition of different spectrums mixed together, light fixtures using RGB/RGBA modules do not replicate natural sunlight particularly well. On a sunny day, sunlight in its purest form is made up of many different spectrums of light coming from many different directions. It may include direct light from the sun that may have a very complete spectrum, indirect light from diffuse sky radiation and reflections of both of these lights from the Earth and terrestrial objects.

There is a push within building designs to incorporate more natural daylighting in work spaces through the use of more windows and the addition of sky lights. Unfortunately, using natural light to illuminate spaces is not always practical and artificial lighting is required. Against this background, there is a need for solutions that will mitigate at least one of the above problems, particularly improving the light output from LED lighting apparatus to better replicate sunlight.

BRIEF DESCRIPTION OF THE DRAWINGS

A detailed description of embodiments of the invention is provided herein below, by way of example only, with reference to the accompanying drawings, in which:

FIG. 7A is a printed circuit board design for a segment of a grid light engine according to an alternative embodiment of the present invention.

Figure 1A:
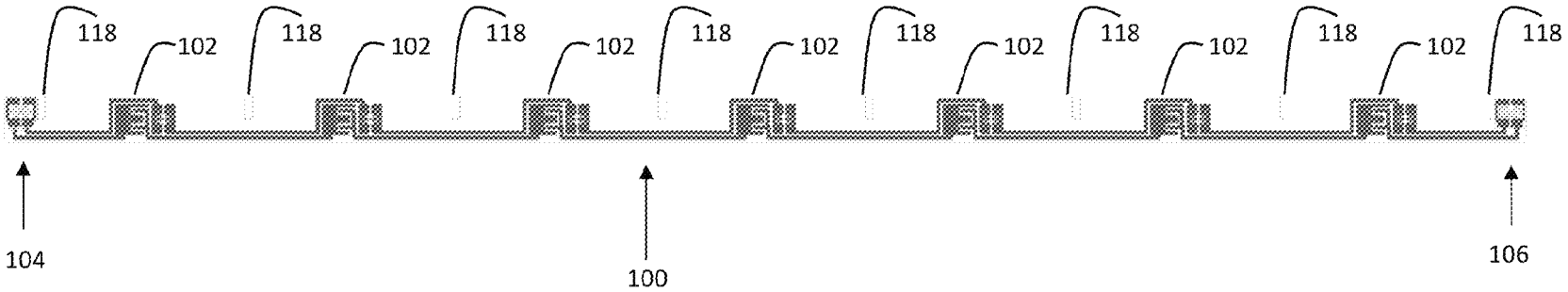
FIG. 1A is a printed circuit board design for a segment of a grid light engine according to one embodiment of the present invention.

It is to be expressly understood that the description and drawings are only for the purpose of illustration of certain embodiments of the invention and are an aid for understanding. They are not intended to be a definition of the limits of the invention.

SUMMARY OF THE INVENTION

According to a first broad aspect, the present invention is a lighting apparatus comprising a plurality of elongated segments interconnected perpendicularly to form a grid light engine, each segment comprising a plurality of groups of LEDs on both sides such that, when interconnected together, the grid light engine is operable to emit light inwardly to a plurality of grid squares formed by the segments. The lighting apparatus further comprises a back panel light engine comprising a plurality of LEDs, the back panel light engine being coupled adjacent to the grid and operable to emit light from its LEDs through the grid.

According to a second broad aspect, the present invention is a grid light engine comprising a plurality of elongated segments interconnected perpendicularly to form a grid. Each segment comprises a plurality of groups of LEDs on both sides such that, when interconnected together, the grid light engine is operable to emit light inwardly to a plurality of grid squares formed by the segments.

According to a third broad aspect, the present invention is a lighting apparatus comprising: a first set of LEDs directed to emit light in a first direction; and a second set of LEDs directed to emit light in a second direction. The first set of LEDs comprises at least one first type of LED and the second set of LEDs comprises at least one second type of LED, wherein the first and second types of LED emit different light spectrums.

These and other aspects of the invention will become apparent to those of ordinary skill in the art upon review of the following description of certain embodiments of the invention in conjunction with the accompanying drawings.

DETAILED DESCRIPTION OF EMBODIMENTS

The present invention is directed to apparatus and system for emitting light using a grid light engine. In particular embodiments of the present invention, a light fixture is formed using components that allow for different sets of Light Emitting Diodes (LEDs) to be projected in different directions. When the different sets of LEDs emit different spectrum outputs, the light fixture can appear visually different depending upon the viewers' perspective. When the different sets of LEDs are controlled separately, the light fixture can be used to generate various visual effects including, but not limited to, the appearance of sunrises, afternoon sky and sunsets over a day. In some embodiments, the architecture of the present invention can allow for the perception of significant depth to a viewer, despite the entire light fixture possibly being only a few inches deep.

The light fixtures according to various embodiments of the present invention comprise a plurality of elongated rectangular light engine segments with a plurality of LEDs coupled on both sides. These segments can be interconnected perpendicularly to form a grid of lights with "light squares" having light emitted from all four sides inwards, hereinafter referred to as a grid light engine. The grid light engine may be integrated with a back panel light engine to form a light fixture that can be installed in a ceiling. The back panel light engine may emit light at various spectrums (ex. cool white, blue) downwards while the "light squares" formed with the grid light engine may emit other light spectrums (ex. warm white, red) substantially angled out.

Figure 1B:
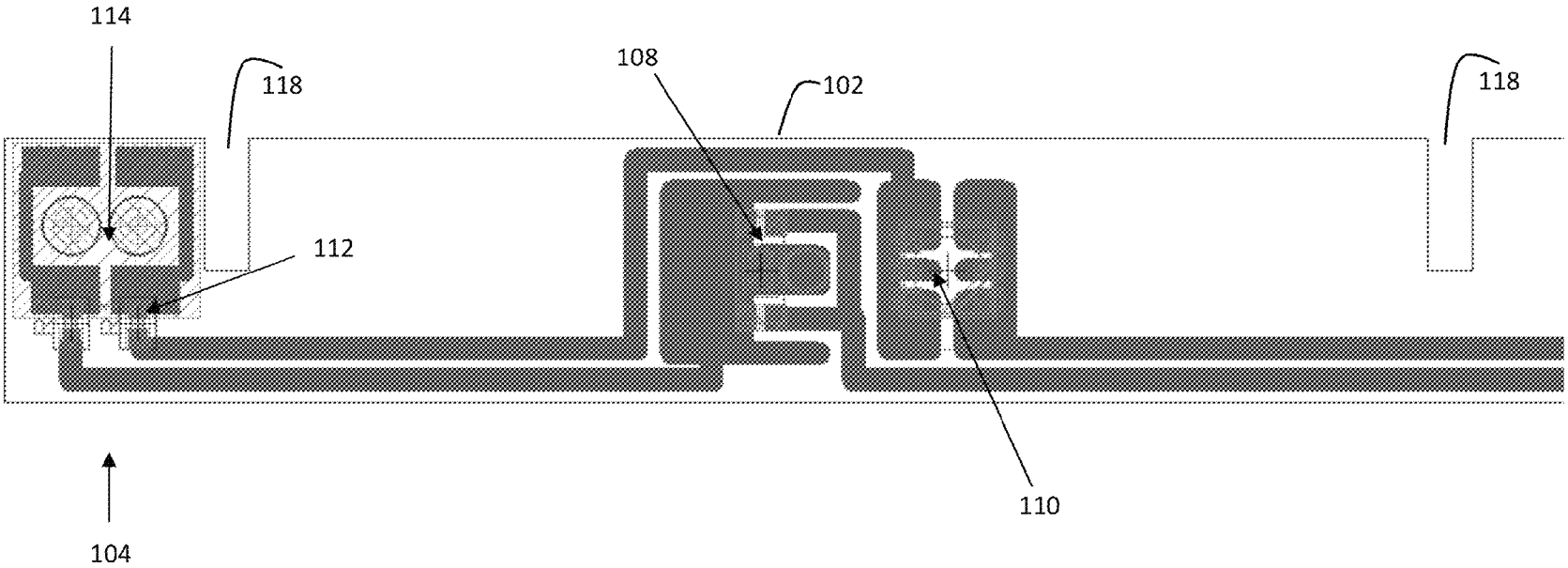
FIGS. 1B and 1C are zoomed in depictions of first and second ends of the printed circuit board design of FIG. 1A.
Figure 1C:
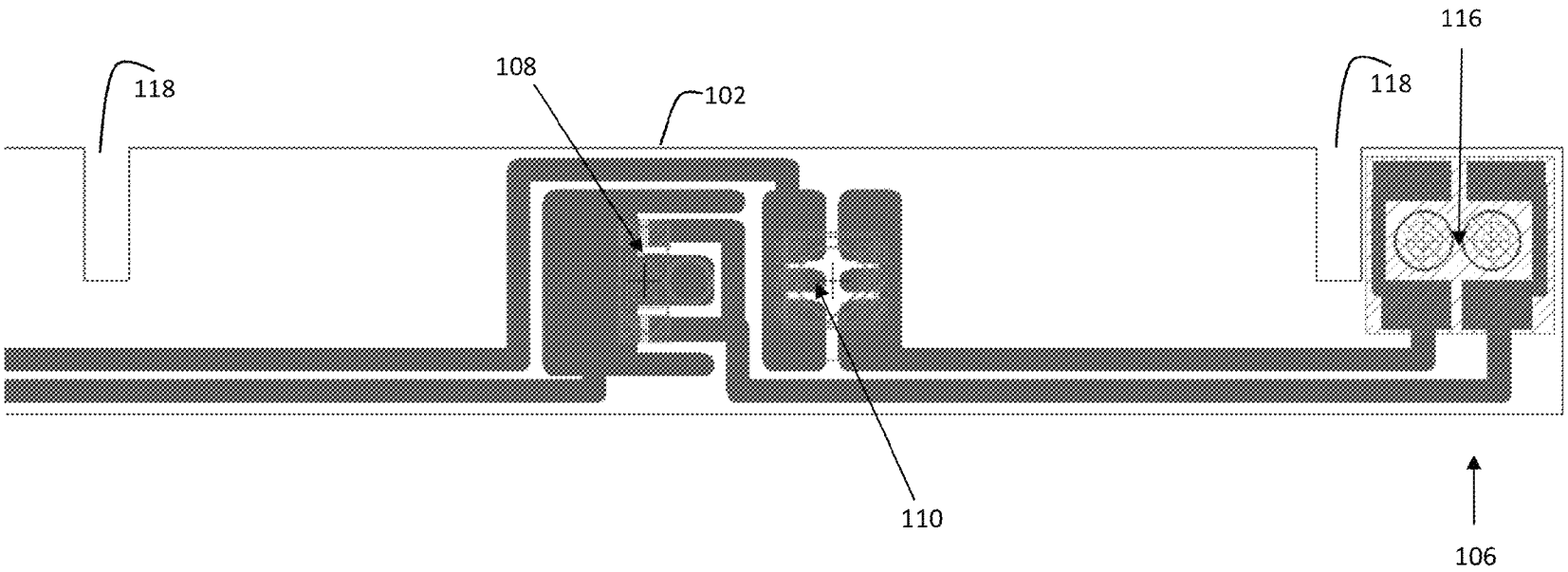

FIG. 1A is a printed circuit board design for a segment 100 of a grid light engine according to one embodiment of the present invention. FIGS. 1B and 1C are zoomed in depictions of first and second ends 104,106 of the printed circuit board design of FIG. 1A. In this design, the segment 100 is an elongated rectangular board built upon an aluminum metal core with dimensions of approximately 23" by 1". The board is printed on both sides of the metal core with a plurality of groups 102 of LED solder locations along its length. Alternatively, the board comprises two boards back-to-back to provide LED solder locations on both sides. In the example of FIG. 1A, there are seven groups 102 of LED solder locations on each side of the board, each group consisting of two LED solder locations 108,110 for two respective types of LEDs. In this example, the two LED solder locations 108,110 within each group 102 are different solder footprints as the assembled light engine segment 100 will comprise LEDs with two different form factors within each group. In one case, the LED solder location 108 is for a warm white LED while the LED solder location 110 is for a red LED. In other embodiments, other combination of light spectrum outputs may be implemented or two or more of the LEDs may be the same light spectrum output. Further, in some embodiments, only a single LED may be implemented within each group 102 or in other cases, more than two may be implemented.

Electrically, on each side of the board, the LED solder locations 108 within each group are connected in series and the LED solder location 110 within each group are connected in series. Each of these electrical circuits then connects to a respective power node 114 via a respective resistor solder location 112 at the first end 104 of the board and connects to a return path node 116 at the second end 106 of the board. The operation of the electrical circuit for the fully assembled segment 100 of the grid light engine in this example implementation will be described in more detail with reference to FIG. 6A.

Figure 1D:
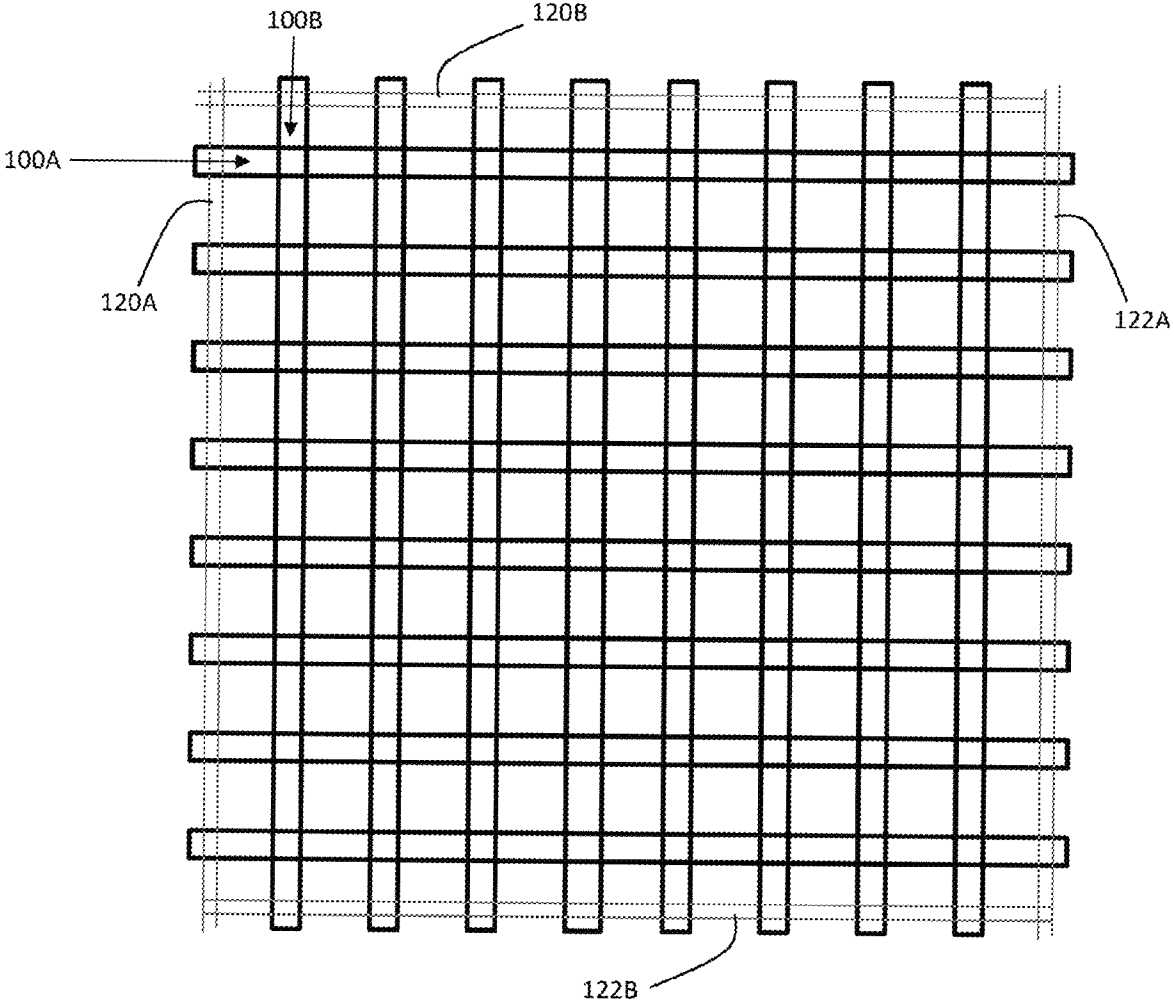
FIG. 1D is an illustration of a sample grid light engine formed using a plurality of segments similar to the printed circuit board of FIG. 1A interconnected according to one embodiment of the present invention.

In between each group of LED solder locations 102 and adjacent to the ends 104,106, the printed circuit board comprises grooves 118 for physically interconnecting perpendicularly this board with other similar boards to form a grid light engine. FIG. 1D is an illustration of a sample grid light engine formed using a plurality of segments 100 interconnected according to one embodiment of the present invention. In this case, the grid light engine comprises eight segments 100A that are horizontal in the drawing and eight segments 100B that are vertical in the drawing. Although not indicated on FIG. 1D, each of the segments 100A, 100B are oriented on their edges such that the LEDs on one segment 100A are facing LEDs on an adjacent segment 100A and the LEDs on one segment 100B are facing LEDs on an adjacent segment 100B. This interconnecting of segments 100A, 100B using the grooves 118 allows for the formation of 49 "light squares" in which light is emitted inwards from all four sides of the square.

In this embodiment, each of the power nodes 114 of the segments 100A are coupled to power cables 120A while each of the power nodes 114 of the segments 100B are coupled to power cables 120B. Similarly, each of the return path nodes 116 of the segments 100A are coupled to return path cables 122A while each of the return path nodes 116 of the segments 100B are coupled to return path cables 122B. In some embodiments of the present invention, at least one of the power cables 120A, 120B and the return path cables 122A, 122B are coupled to a controller that manages the current flowing through the LEDs, and therefore the intensity of the LEDs. This may be done by directly controlling the instantaneous current or by using transistors to turn on/off the LEDs within a duty cycle, also known as Pulse Width Modulation (PWM) dimming. One example implementation is depicted with reference to FIG. 6A.

In some embodiments, the LEDs of similar type on each side of the segments 100A, 100B share the same power cables 120A, 120B and share the same return path cables 122A, 122B. In this case, there may be one power cable 120A and one return path cable 122A for each of the two types of LEDs (ex. warm white and red) within the segments 100A. Similarly, there may be one power cable 120B and one return path cable 122B for each of the two types of LEDs within the segments 100B. All of the LEDs of the first type (ex. warm white) may be controlled together irrespective of their direction within the light square and all of the LEDs of the second type (ex. red) may be controlled together. In some embodiments, the two types of LEDs may be controlled together as well. In other embodiments, one or both of the types of LEDs may be not controlled for intensity and simply operate as on/off.

In another embodiment, the LEDs of similar type on each side of the segments 100A, 100B can be independently controlled. In this case, they would not share both the power cables 120A,120B and the return path cables 122A, 122B. In one example, the LEDs on each side of the segments 100A, 100B may share power cables 120A, 120B but may have independent return path cables 122A, 122B. In one example, all of the LEDs of a particular type facing a particular direction within the light squares would all be controlled together and would be controlled independently to the LEDs of that particular type facing the other three directions within the light square. Other control architectures are possible in alternative embodiments. For instance, in some cases, other subdivisions of groups of LEDs could be controlled independently, based on type, direction and/or location within the overall grid. In one implementation, individual groups of LEDs within particular light squares could be controlled together and act like a pixel within the grid light engine.

Although described using power cables and return path cables, it should be understand that other means for connecting the power nodes to a high voltage and the return path nodes to a low voltage may be used. For instance, a connection board could be used perpendicular to each end of the segments to properly connect the power and return path nodes to a controller and/or power supply.

Figure 7B:
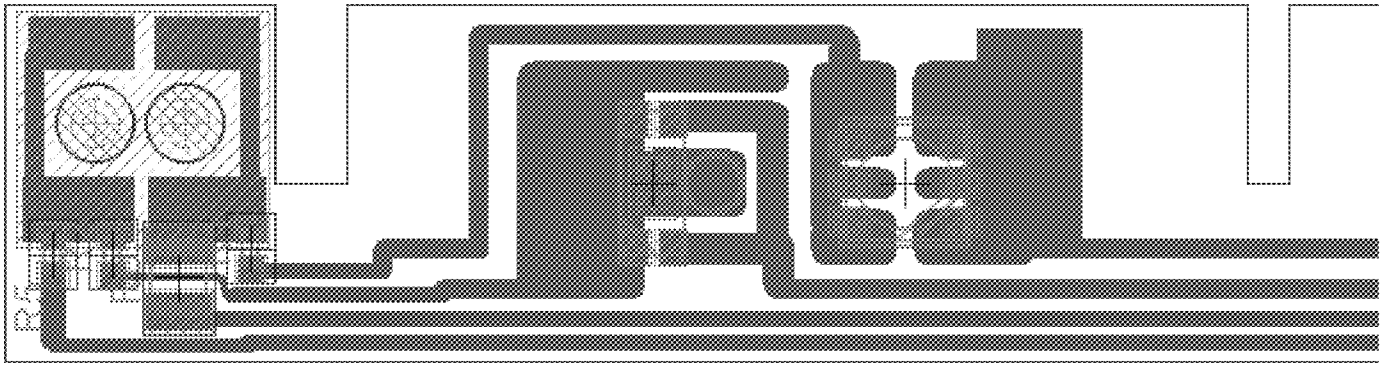
FIGS. 7B and 7C are zoomed in depictions of first and second ends of the printed circuit board design of FIG. 7A.
Figure 7C:
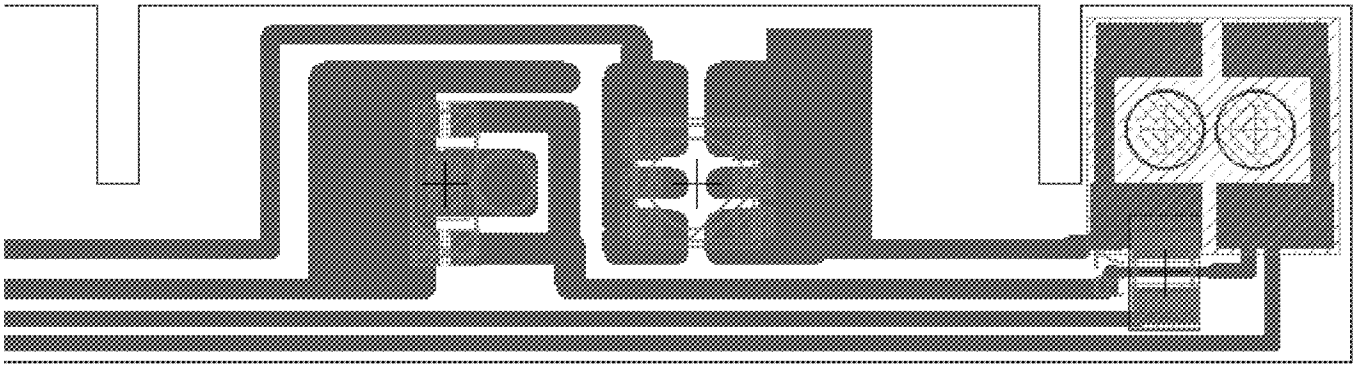

FIG. 7A is a printed circuit board design for a segment of a grid light engine according to an alternative embodiment of the present invention. FIGS. 7B and 7C are zoomed in depictions of first and second ends of the printed circuit board design of FIG. 7A. In this design, each side of each segment of the grid light engine comprises fourteen groups of LEDs, each group comprising two different LEDs, similar to the segment of FIG. 1A. In the design of FIG. 7A, each side of each segment comprises twice as many LEDs as the design of FIG. 1A. The dimensions of the design of FIG. 1A are similar to the design of FIG. 1A and simply the size of the light squares has decreased. In the design of FIG. 7A, after the segments have been interconnected, there will be a total of 196 light squares spread across a 23"×23" grid with a total of 30 segments used (15×15) across the grid.

Figure 2A:
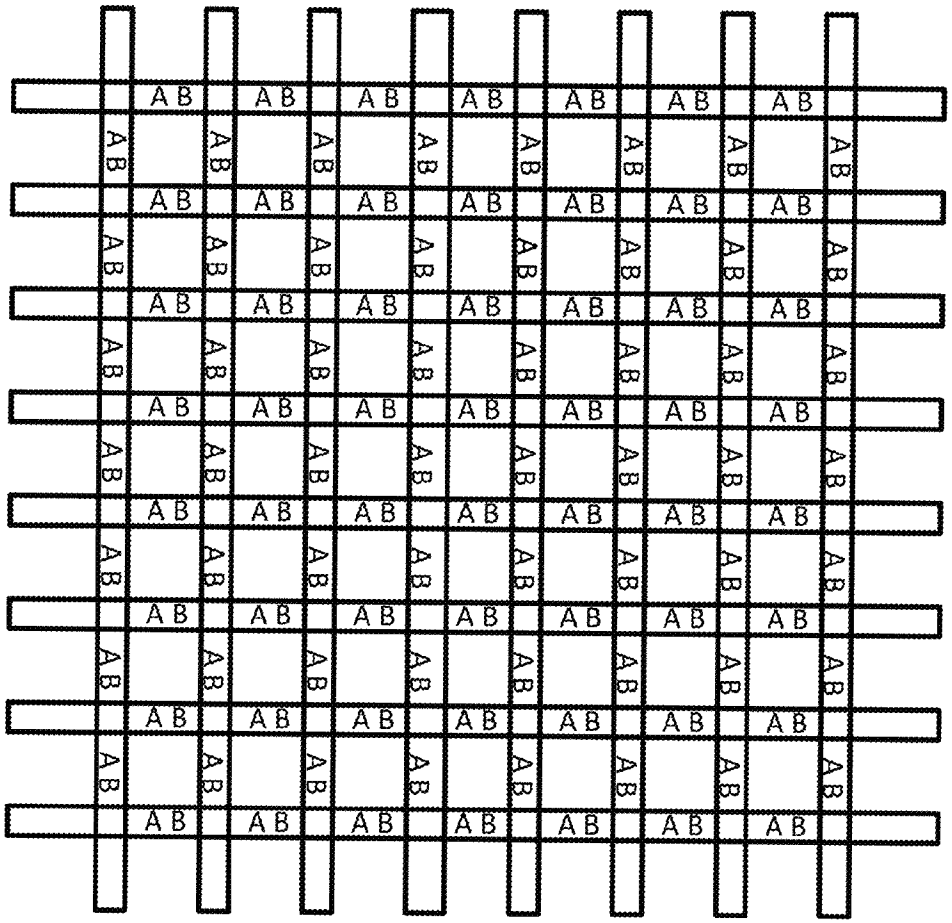
FIG. 2A is a logical depiction of the sample grid light engine of FIG. 1D with two sets of LEDs integrated.

FIG. 2A is a logical depiction of the sample grid light engine of FIG. 1D with two sets of LEDs integrated. In this case, a first type of LED is labeled as "A" and a second type of LED is labeled as "B". In one implementation, the "A" LEDs may comprise warm white LEDs while the "B" LEDs may comprise red LEDs. It should be understood that, although not properly shown in FIG. 2A, each of the segments 100 is on its edge with LEDs of both types A,B on both sides of the segments 100 facing each other to form inwardly emitting light squares. In the case that the LEDs are warm white and red LEDs, the grid light engine will emit warm white and red light in all four directions surrounding the grid light engine, with only a limited amount of light being reflected outwards. If a light fixture is mounted on the ceiling with the grid light engine, only a limited amount of the warm white and red light would be reflected directly downwards.

Although not depicted in FIG. 2A for simplicity, it should be understood that means for connecting the power nodes and return path nodes of the segments 100 to a controller and/or power supply is required. Further, although depicted with relatively long ends 104, 106 within FIG. 2A, it should be understood that these ends may be short in order to limit any dark area within a light fixture along the outside edges. In some embodiments, the outer segments 100 within the grid light engine may not have LEDs assembled on the outside edges of the grid as these areas may be covered by a light fixture encasement.

Figure 2B:
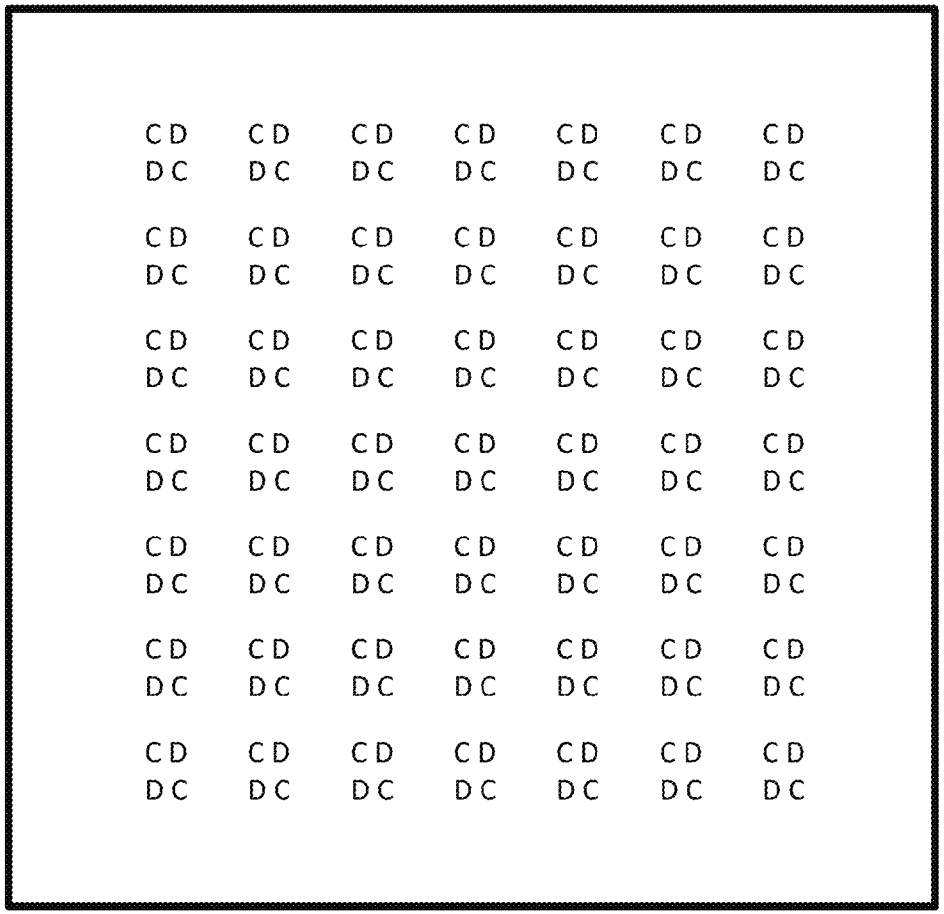
FIG. 2B is a logical depiction of a sample back panel light engine with two sets of LEDs integrated according to one embodiment of the present invention.

FIG. 2B is a logical depiction of a sample back panel light engine with two sets of LEDs integrated according to one embodiment of the present invention. In one example, the back panel light engine may be implemented on a metal core board and consist of one or a plurality of boards that total 23"×23" in dimensions. In this way, the back panel light engine is of similar length and width dimensions as the grid light engine of FIG. 2A. It should be understood that other dimensions for the grid light engine and for the back panel light engine are possible. Further, alternative shapes may be contemplated in some embodiments.

In the embodiment depicted in FIG. 2B, two types of LEDs are implemented and grouped into 49 sets, each set consisting of a plurality of LEDs labeled as type "C" and a plurality of LEDs labeled as type "D". In one embodiment, the type "C" LEDs are cool white LEDs while the type "D" LEDs are blue LEDs. Other spectrum outputs for these LEDs are possible and, in some embodiments, more or less than two types of LEDs may be implemented. Further, although grouped together into 49 groups of LEDs, in some embodiments, there is no grouping of LEDs and the LEDs are simply substantially evenly distributed across the back panel light engine. Also, other number of sets may be utilized and/or different number of LEDs may be utilized within a set. The use of four LEDs within a group is only due to convenience. In one embodiment, four type "C" and four type "D" LEDs are implemented within each set.

Electrically, the LEDs within the back panel light engine may be connected together in numerous manners. In one case, the LEDs may simply be connected into a large number of sets of seven LEDs. These sets of seven LEDs may be coupled in parallel and controlled together or controlled separately, depending upon the control architecture. In one embodiment, all of the LEDs labeled as type "C" are controlled together and all of the LEDs labeled as type "D" are controlled together. In other cases, both types of LEDs are controlled together. In yet other implementations, segments of LEDs within a particular type may be controlled separately based upon their location within the back panel light engine. For instance, in one embodiment, each of the 49 groups of LEDs are independently controlled.

Figure 2C:
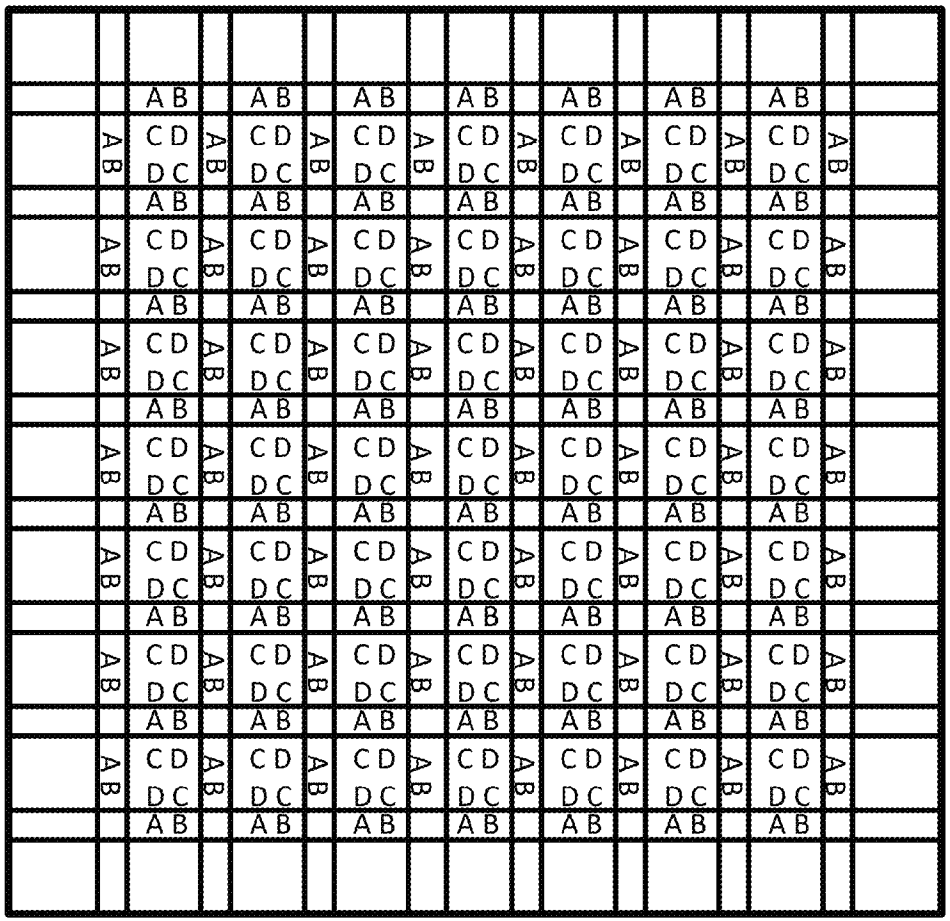
FIG. 2C is a logical depiction of a sample light fixture comprising the sample grid light engine of FIG. 2A and the sample back panel light engine of FIG. 2B.

Although not depicted in FIG. 2B for simplicity, it should be understood that means for connecting the back panel light engine to a controller and/or power supply is required. Further, although depicted with relatively bare edges within FIG. 2B, it should be understood that the back panel light engine may have LEDs close to the edges of the panel in order to limit any dark area within a light fixture along the outside edges. Yet further, although shown to have only four LEDs within each group of LEDs, in some embodiments more or less LEDs are FIG. 2C is a logical depiction of a sample light fixture comprising the sample grid light engine of FIG. 2A and the sample back panel light engine of FIG. 2B. Although not properly shown, the light emitted from the type "A" and "B" LEDs is being directed inwards within the light squares and the light emitted from the type "C" and "D" LEDs is being directed outwards (or downwards if the sample light fixture was installed on a ceiling). Effectively, in this sample implementation, each light square has four type "A" LEDs, four type "B" LEDs and only two type "C" and type "D" LEDs. In another implementation, all four of the types of LEDs are equal within a light square. In particular, in one embodiment, there are four LEDs of each type implemented within each light square, four each of types "C" and "D" within the back panel light engine and one each of types "A" and "B" on each segment that together forms the square.

Figure 3A:
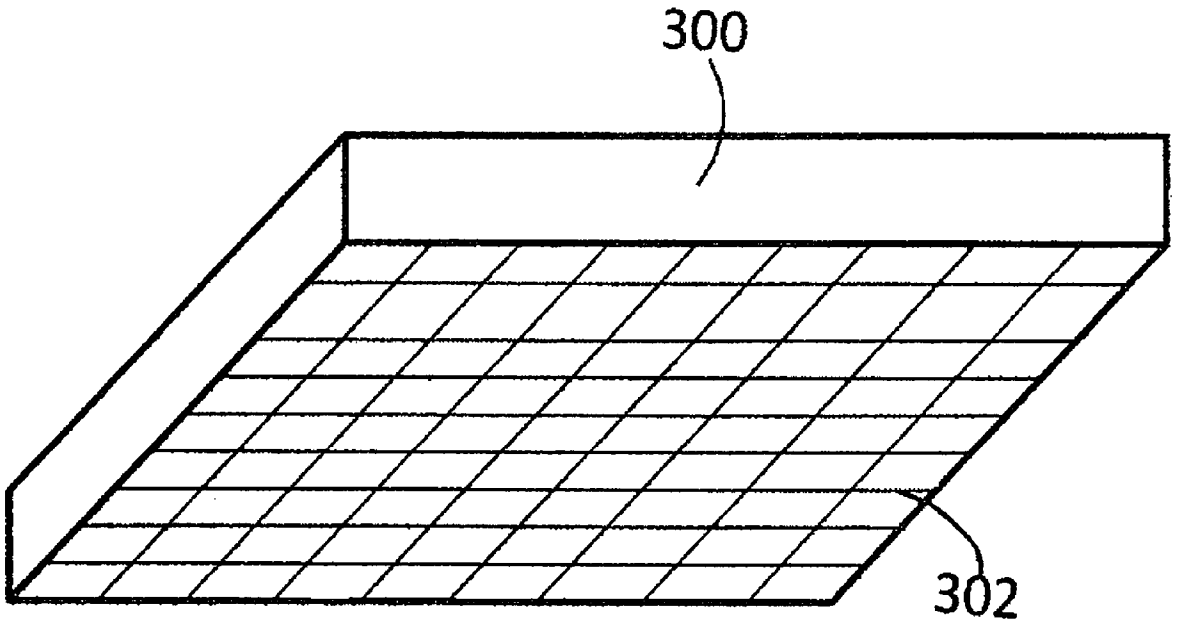
FIG. 3A is an illustration of a sample light fixture according to embodiments of the present invention with no optics.

FIG. 3A is an illustration of a sample light fixture according to embodiments of the present invention with no optics. As shown, the light fixture comprises a grid light engine 300 similar to that described with reference to FIG. 2A and a light fixture encasement 302. Not shown, the sample light fixture further comprises a back panel light engine that is affixed to the back of the encasement 302. In some cases, the back panel light engine may be used as the back of the encasement 302 and the encasement is simply a square frame for the light fixture. In some embodiments, the grid light engine 300 may be directly connected to the back panel light engine (not shown). This connection could be completed in a number of ways including, but not limited to, bending small elements of the back panel light engine perpendicular and using an affixing means such as screws to connect these small elements to a plurality of the segments of the grid light engine 300; bending small elements of a plurality of the segments of the grid light engine 300 perpendicular and using affixing means to connect the grid light engine 300 to the back panel light engine; using clips to couple a plurality of the segments of the grid light engine 300 to the back panel light engine; using magnets and/or using an adhesive element. In other embodiments, the grid light engine 300 and the back panel light engine (not shown) are independently connected to the encasement 302.

Figure 3B:
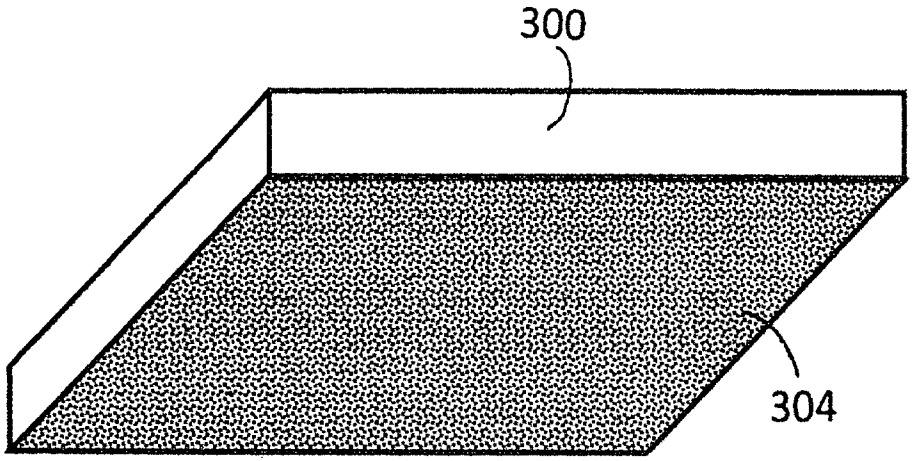
FIG. 3B is an illustration of a sample light fixture according to embodiments of the present invention with optics.

FIG. 3B is an illustration of a sample light fixture according to embodiments of the present invention with optics 304. In some embodiments of the present invention, the optics 304 used is a fogging glass. Fogging glass allows for the light to scatter slightly as it passes through the optics 304 but does not force the full mixing of the light output. Using a fogging glass for the optics 304 allows for most of the light output from the grid light engine 300 and the back panel light engine to be pass without substantially changing the direction of the light. With an appropriate optics 304 consisting of fogging glass, the overall light fixture can emit different light spectrums in distinct directions without viewers detecting the light squares divisions caused by the grid light engine 302. In some embodiments, in which the types of LEDs are selected properly, viewers of the light fixture may perceive "depth" from the light fixture, despite the light fixture potentially being only a few inches thick.

Figure 4A:
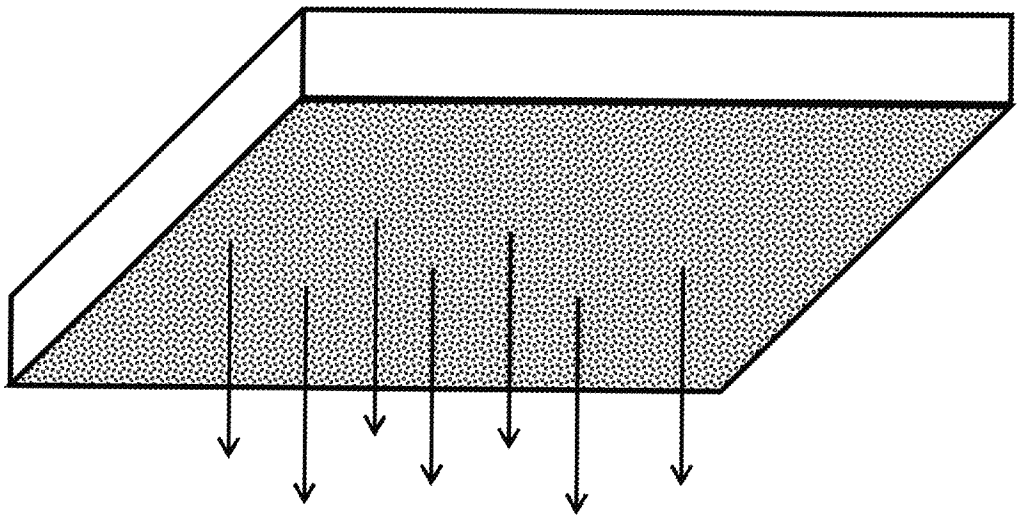
FIGS. 4A and 4B are illustrations of the light fixture of FIG. 3B depicting light output from the back panel light engine and light output from the grid light engine respectively.
Figure 4B:
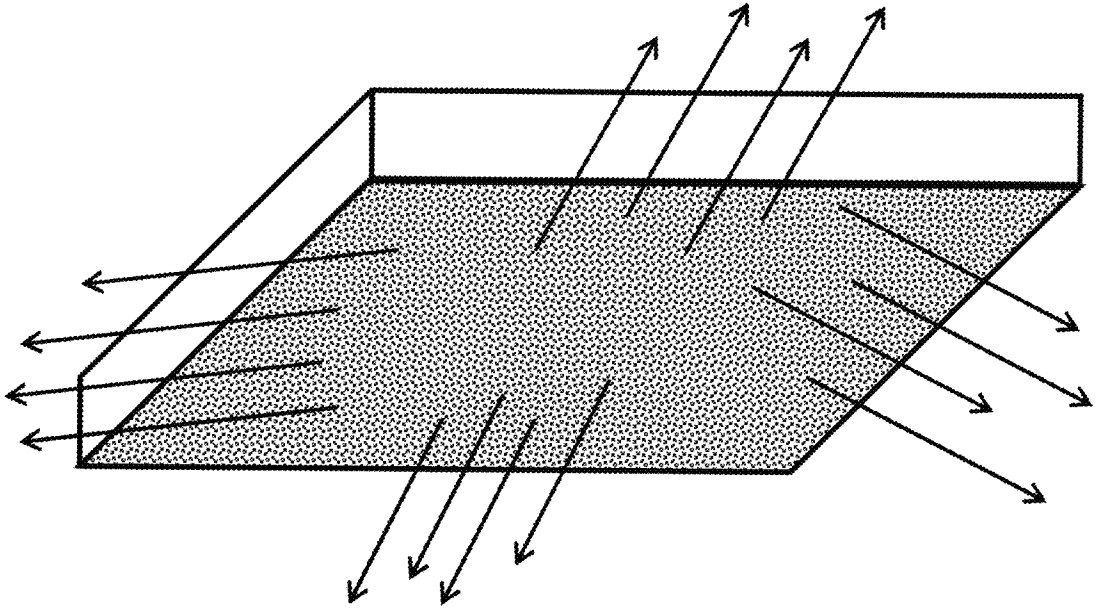

FIGS. 4A and 4B are illustrations of the light fixture of FIG. 3B depicting light output from the back panel light engine and light output from the grid light engine respectively. As shown in FIG. 4A, the back panel light engine emits most of its light in a single direction away from the light fixture (downward if the fixture is mounted on a ceiling). In the case that the type "C" and "D" LEDs are cool white and blue LEDs respectively, the back panel light engine provides a very cool/blue light spectrum downwards. As shown in FIG. 4B, the grid light engine emits a substantial portion of its light at angels in each of four directions. If the light fixture was mounted to a ceiling and one of its edges was parallel with a compass's North/South axis, a large portion of the light emitted by the grid light engine would emit at angles North, East, South and West, with substantially less light going downwards compared to the back panel light engine. In the case that the type "A" and "B" LEDs are warm white and red LEDs respectively, the grid light engine provides a very warm/red light spectrum outwards from the light fixture.

Figure 4C:
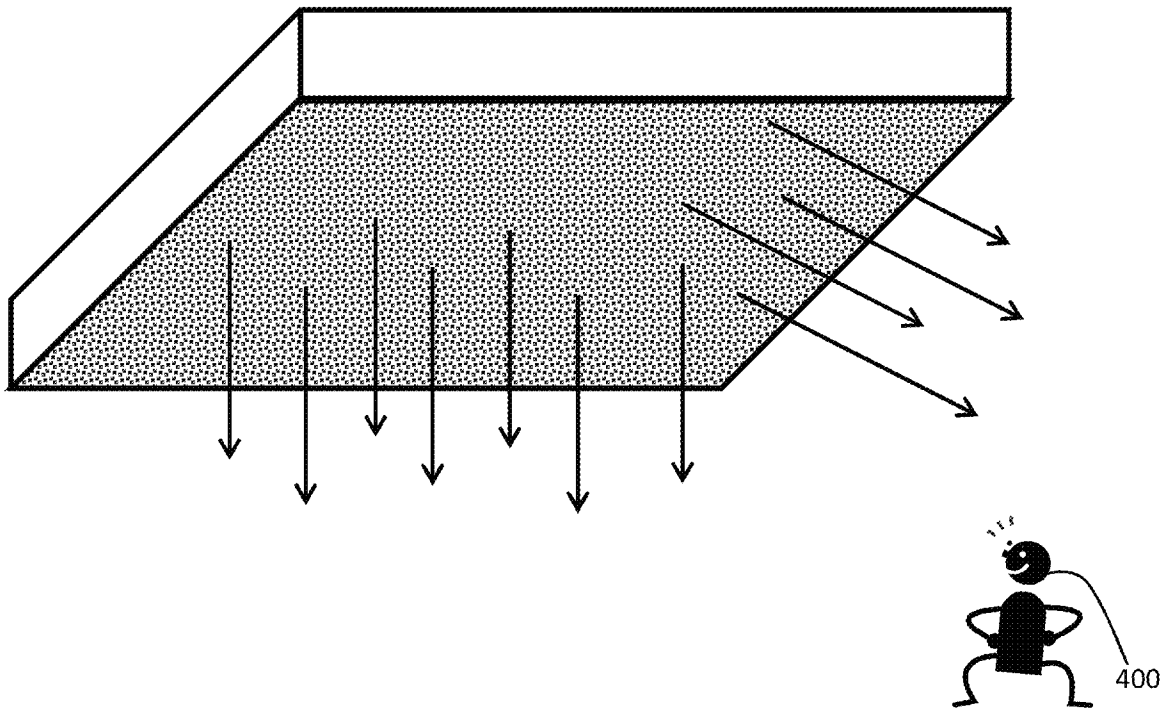
FIG. 4C is an illustration of the light fixture of FIG. 3B depicting the light output as detected by a human local to the light fixture.

FIG. 4C is an illustration of the light fixture of FIG. 3B depicting the light output as detected by a person 400 local to the light fixture if all of the LEDs are turned on together. As the person 400 moves, different spectrums of light emitted by the light fixture will reach him/her. When further from the light fixture, the light will be warmer white and reddish while when under the light fixture, most of the light will be cooler and bluish. In some embodiments, this change in light spectrum from different perspectives can provide a perception of depth from the light fixture and provide similarities to a natural blue sky and sun.

In some implementations, the intensity of the various types of LEDs may change over time and the balance between the warm white/red LEDs and the cool white/blue LEDs may allow for a replication of a sunrise, morning sun, afternoon sun and a sunset. In particular, in the morning, the intensity of the warm white LEDs can be reduced and the red LEDs could be increased, providing an overall lighting experience that reflects closely to a sunrise. As the day continues, the light fixture could dim the red LEDs and increase the intensity of the warm white LEDs along with the cool white and blue LEDs in order to provide a blue sky affect similar to one that would be seen on a beautiful clear sunny day in the early afternoon. Later in the day, the light fixture can control the LEDs to provide a brilliant sunset by increasing the mix of red LEDs and decreasing the intensity of the cool white LEDs. It should be understood that numerous other scenarios could be implemented and additional colors could be added to the light fixture to provide additional affects. Further, if the individual sides of the segments within the grid light engine are independently controllable, other affects could be implemented. For instance, the sunrise could occur primarily using the red LEDs facing East, the intensity of the various types of LEDs could change slowly over the day from East to West and finally a sunset could be replicated primarily using the warm white and red LEDs facing West. One skilled in the art would understand that other applications for the directionality of the different types of LEDs are possible and the above example is only one specific implementation.

Figure 5A:
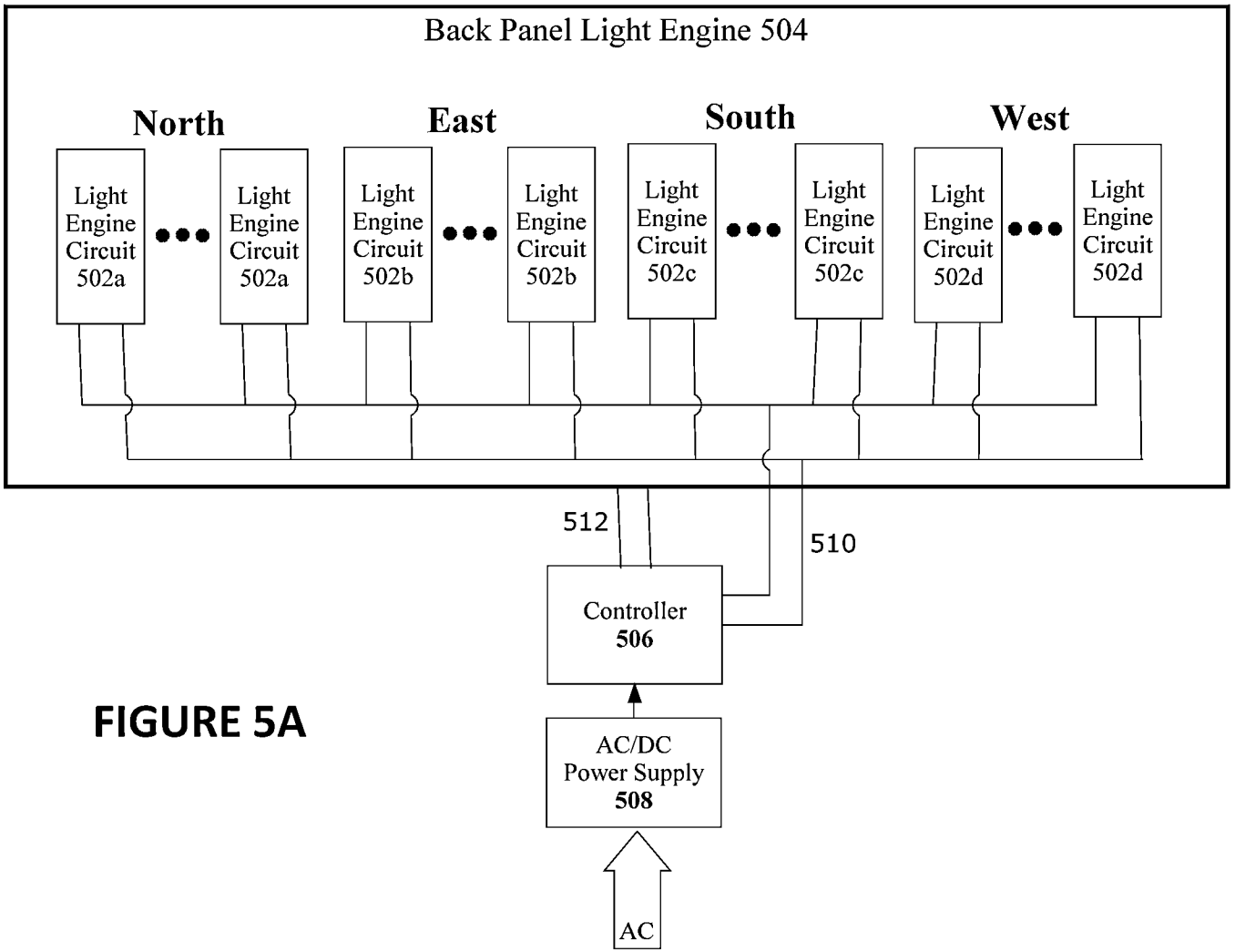
FIGS. 5A and 5B are logical block diagrams depicting components within a light fixture according to first and second embodiments of the present invention.
Figure 5B:
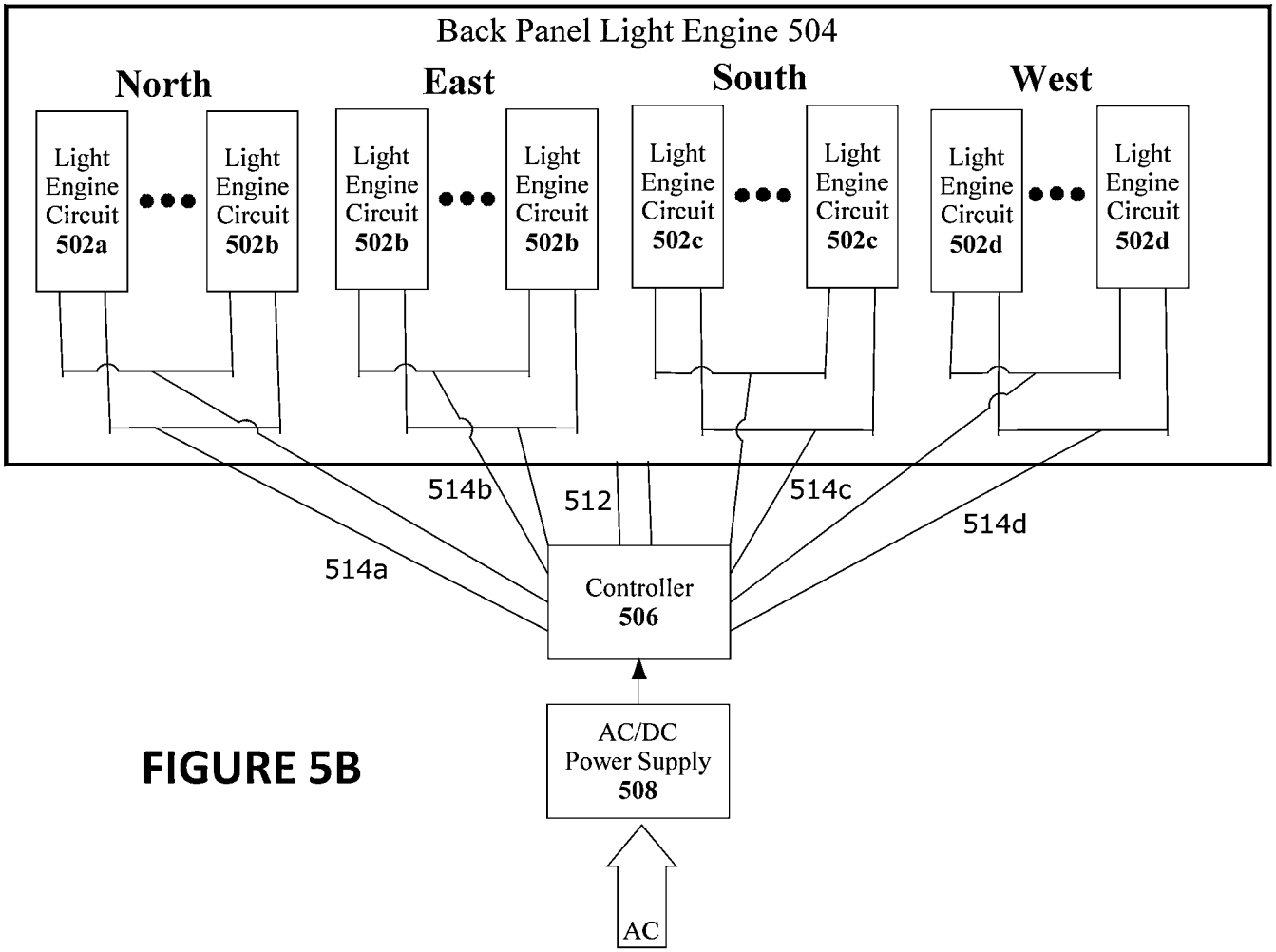

FIGS. 5A and 5B are logical block diagrams depicting components within a light fixture according to first and second embodiments of the present invention. As shown in FIG. 5A, the light fixture comprises a grid light engine that has been broken down into four groups of light engine circuits based on the direction of the LEDs; North, East, South, West. Within each group, there is a plurality of light engine circuits: circuits 502*a* comprising LEDs directed North, circuits 502*b* comprising LEDs directed East, circuits 502*c* comprising LEDs directed South and circuits 502*d* comprising LEDs directed West. These light engine circuits will be implemented within segments of the grid light engine. For example, the light engine circuits directed North will be on the opposite side of the segments of the grid light engine to the light engine circuits directed South. Similarly, the light engine circuits directed East will be on the opposite side of the segments of the grid light engine to the light engine circuits directed West. Each of the light engine circuits may comprise LEDs of one or more types. In this implementation, the light engine circuits comprise two types of LEDs, similar to that previously described with reference to FIG. 2A.

The light fixture further comprises a back panel light engine 504, a controller 506 and an AC/DC power supply 508. The back panel light engine 504 may comprise a plurality of light engine circuits comprising one or more types of LEDs similar to that described previously with reference to FIG. 2B. The controller 506 and the power supply 508 may work in unison to convert AC power from a wall socket to a constant current to be provided to the LEDs within the light fixture. In some embodiments, the controller and the power supply may be combined into a single component. In other embodiments, more than one power supply and/or controller may be necessary to control all of the LEDs within the light fixture. In some embodiments, the controller does not provide a constant current output and instead provides a constant voltage. In this case, the current flowing through the LEDs may adjust based on a number of factors including the temperature of the LEDs.

As shown in FIG. 5A, each of the groups of light engine circuits 502*a*, 502*b*, 502*c*, 502*d* are coupled to the controller 506 by the same two control lines 510 in this implementation. The control lines 510 are the return paths for the first and second types of LEDs respectively within the light engine circuits 502*a*, 502*b*, 502*c*, 502*d*. In this design, the power rail is consistent throughout the light fixture and is not shown for simplicity. Since the control lines 510 are the same across all of the light engine circuits, all of the light output in each direction (North, East, South, West) will be consistent. The light engine circuits within the back panel light engine 504 are coupled to the controller 506 by the two control lines 512. The control lines 512 are the return paths for the two types of LEDs within the back panel light engine 504. It should be understood that control over the LEDs could be accomplished in another manner than controlling the return paths of the LEDs. For instance, control over the light engine circuits could be accomplished by controlled the power rails coupled to the light engine circuits, in which case the light engine circuits may have a common ground rail. Further, control over the LEDs may be done by controlling specific instantaneous currents flowing through the various light engine circuits in other manners.

FIG. 5B is similar to the light fixture described with reference to FIG. 5A and like elements are labeled with the same references. The difference in FIG. 5B is that each of the groups of light engine circuits 502*a*, 502*b*, 502*c*, 502*d* are controlled independently from the controller 506. As the return paths of each of the light engine circuits with the various groups may be controlled differently, the intensity of the various LEDs in the different groups can be maintained at different levels. In so doing, the light fixture of FIG. 5B can have different light outputs in each of the various directions from the grid light engine comprising the light engine circuits 502*a*, 502*b*, 502*c*, 502*d*. As described previously, this would allow for custom light spectrums in the various directions. For example, it would allow for a sunrise affect to be focused on the LEDs facing East and allow for a sunset affect to be focused on the LEDs facing West, etc. With different color LEDs and different control architectures, it should be understood that a wide range of affects can be generated when groups of LEDs focused in different directions are controlled independently.

Figure 6A:
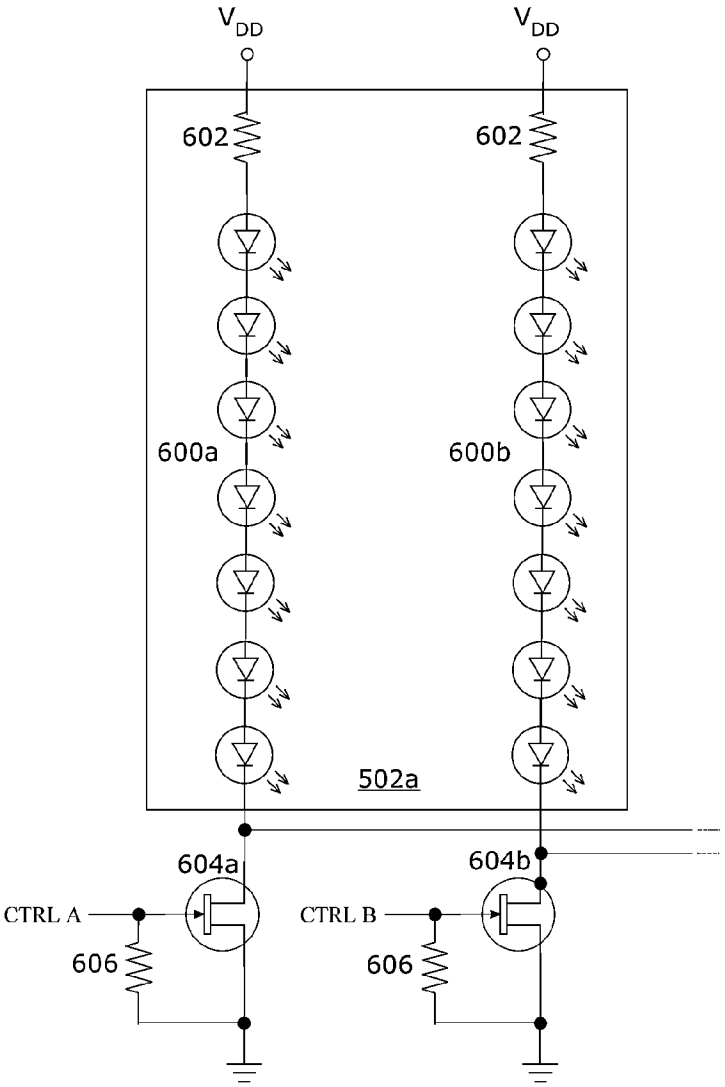
FIGS. 6A and 6B are sample electrical diagrams for light engine circuits within a grid light engine and a back panel light engine respectively according to one embodiment of the present invention.
Figure 6B:
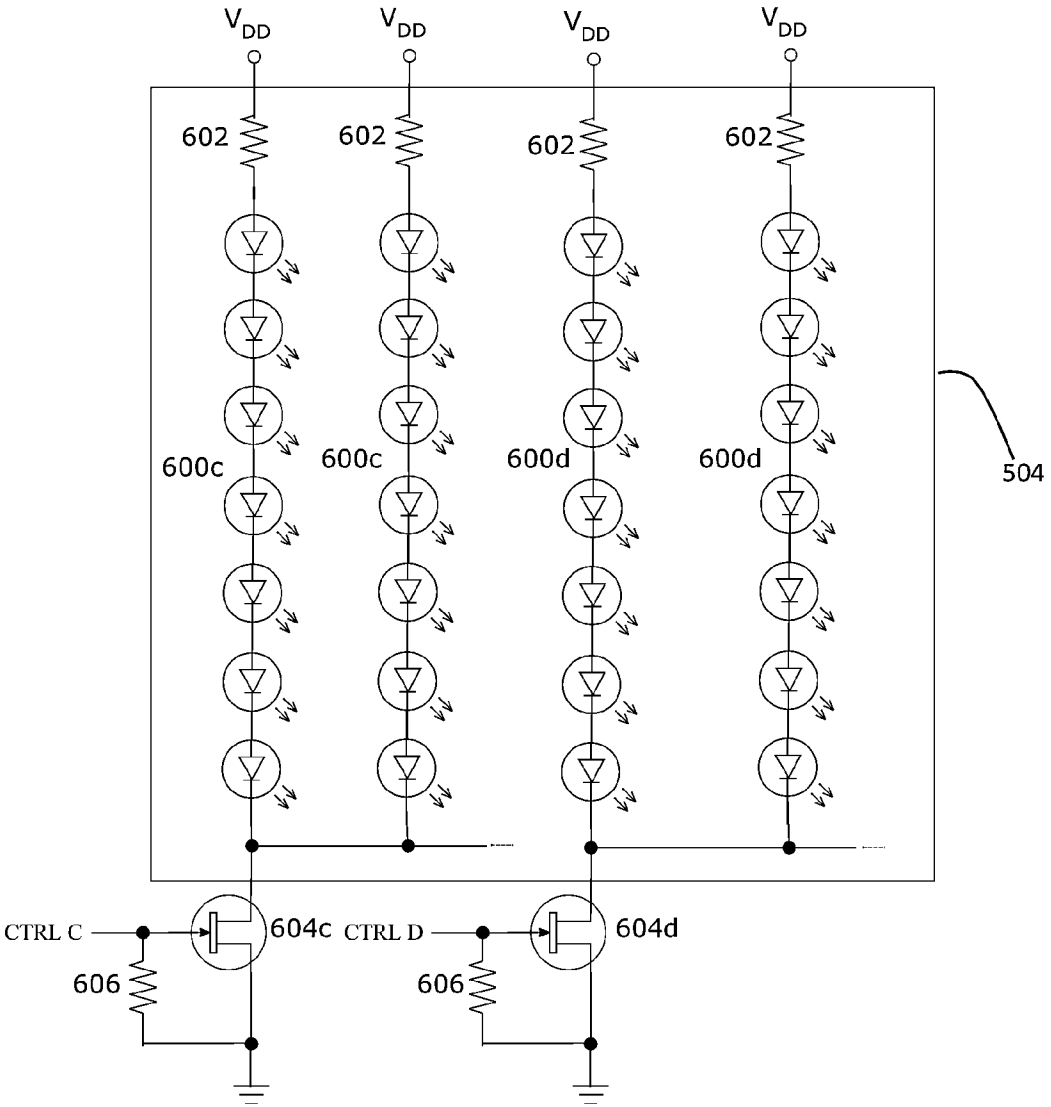

FIGS. 6A and 6B are sample electrical diagrams for the light engine circuits of a grid light engine and a back panel light engine respectively according to one embodiment of the present invention. As shown in FIG. 6A, the light engine circuit 502*a* comprises two sets of seven LEDs 600*a*, 600*b* in series with corresponding resistors 602 between a power rail VDD and a corresponding transistor 604*a*, 604*b*. The edge of the light engine circuit 502*a* between the resistors 602 and the power rail VDD can be seen as power node 114 while the edge of the light engine circuit 502*a* between the set of LEDs 600*a*, 600*b* and the corresponding transistors 604*a*, 604*b* can be seen as return path node 116. In this implementation, the transistors 604*a*, 604*b* are controlled by PWM control signals CTRL A, CTRL B respectively with corresponding pull-down resistors 506 on the gates. When one of the control signals CTRL A, CTRL B is set to a high level by a microcontroller or other control element, the corresponding transistor 604*a*, 604*b* is turned on and the sets of LEDs with a return path through that transistor are enabled. When the control signals CTRL A, CTRL B are set to a low level, the corresponding transistor is turned off and the sets of LEDs with a return path through that transistor are disabled. In some embodiments, within a duty cycle, each of the transistors is set to a high level and a low level for controlled periods of time. The ratio of the high level to low level within a duty cycle indicates the amount of average light that is output from the sets of LEDs whose return path passes through the transistor. In one example, the duty cycle may be one millisecond and the duty cycle ratio may be 60%. In this case, the set of LEDs coupled to the transistor would be enabled for 60% of the time and disabled for 40% of the time within one millisecond. The off time of the LEDs in this case would be sufficiently short so it is undetectable to the human eye.

It should be understood that, although only one set of LEDs 602*a*, 602*b* are shown corresponding to each of the transistors 604*a*, 604*b*, a plurality of light engine circuits 502*a*, 502*b*, 502*c*, 502*d* may be coupled to the transistor 604*a* or transistor 604*b*. The transistors 604*a*, 604*b*, according to some embodiments of the present invention are integrated centrally within the controller 506 and are local to a microcontroller that controls their operation.

As shown in FIG. 6B, the light engine circuits within the back panel light engine 504 comprises a plurality of sets of seven LEDs 600*c* in series with corresponding resistors 602 between a power rail VDD and a transistor 604*c*; and a plurality of sets of seven LEDs 600*d* in series with corresponding resistors 602 between a power rail VDD and a transistor 604*d*. In this implementation, the transistors 604*c*, 604*d* are controlled by PWM control signals CTRL C, CTRL D respectively with corresponding pull-down resistors 506 on the gates. When one of the control signals CTRL C, CTRL D is set to a high level by a microcontroller or other control element, the corresponding transistor 604*c*, 604*d* is turned on and the sets of LEDs with a return path through that transistor are enabled. When the control signals CTRL C, CTRL D are set to a low level, the corresponding transistor is turned off and the sets of LEDs with a return path through that transistor are disabled. In some embodiments, within a duty cycle, each of the transistors is set to a high level and a low level for controlled periods of time. The ratio of the high level to low level within a duty cycle indicates the amount of average light that is output from the sets of LEDs whose return path passes through the transistor.

In some embodiments of the present invention, the various sets of LEDs within the light engines may comprise LEDs of various wattage and flux. In one implementation, LEDs that operate at 1 W to 3 W or higher may be utilized in one set of LEDs while LEDs that operate at approx. 0.3 W may be utilized in another set of LEDs. By adjusting the wattage and flux of the LEDs, the distribution of the light and variable intensity of particular spectrums or directions of light can be designed into the fixture. In one implementation, higher power LEDs may be used in the back panel light engine while lower power LEDs may be used in the grid light engine. In this case, the intensity of the light from the back panel light engine may be greater than the light intensity from the grid light engine. Alternatively, in this case, fewer LEDs may be used in the back panel light engine with each LED being more intense while the light projected by the grid light engine may be more distributed.

In particular embodiments of the present invention, primary optics may be added to one or more sets of the LEDs on the back panel light engine and/or grid light engines. The optics may be used to narrow the beam angle for the LEDs and direct the light in a particular manner as desired. Many LEDs output light with a beam angle of approx. 120° while an LED with some optics can have a narrower beam. In one embodiment, the LEDs on the back panel light engine may have optics applied to narrow their beam angle to a much narrower range (ex. 10-30°) while the LEDs on the grid light engine may continue to have a beam angle of approx. 120°. This would result in different viewing perspectives potentially receiving similar light from LEDs on the grid light engine while receiving very different light from the LEDs on the back panel light engine. As the viewer moved or adjusted his/her viewing angle/direction, different combinations of light spectrums and intensity may be received.

In one embodiment, a grid light engine may not be used at all to achieve different light spectrums for different viewer perspectives. In this case, first and second sets of LEDs may be incorporated on one or more panel light engines in a ceiling. To approximate the sun on a blue sky, the first set of LEDs may be of a first spectrum (ex. cool white, blue) and be integrated with no optics or optics with a wide beam angle. To approximate direct sunlight, the second set of LEDs may be of a second spectrum (ex. neutral or warm white) and be integrated to highly directional optics (ex. 10° beam angle). When these panels are implemented on a ceiling with a fogging optics, a viewer that moves locations or otherwise changes its perspective will receive different mixes of light spectrums. These different mixes of light spectrum can allow the ceiling to have a perception of depth, despite being relatively thin. By controlling the different sets of LEDs and setting them to different intensities over time, various visual effects can be generated for viewers including the perception of a sunrise, a sunset or midday sun. In particular, by adjusting the intensity of the first set of LEDs (LEDs mimicking the sky) and the intensity of the second set of LEDs (LEDs mimicking direct sunlight) different sky effects can be created. It should be understood that this embodiment could be implemented in various other manners and the sets of LEDs could comprise other spectrums of light. Further, there may be more than two sets of LEDs on the panel light engine that are controlled independently and have different optics (or no optics) in order to provide different beam angles for the various sets of projected light spectrums and hence provide a different mix of light spectrums for different viewer perspectives.

Although various embodiments of the present invention have been described and illustrated, it will be apparent to those skilled in the art that numerous modifications and variations can be made without departing from the scope of the invention, which is defined in the appended claims.

What is claimed is:

1. A lighting apparatus comprising:

a plurality of elongated segments interconnected perpendicularly to form a grid light engine, each segment comprising a plurality of groups of LEDs such that, when interconnected together, the grid light engine is operable to emit light inwardly to a plurality of grid squares formed by the segments; and a back panel light engine comprising a plurality of LEDs, the back panel light engine operable to emit light from its LEDs through the grid; and wherein the plurality of groups of LEDs on the segments comprise at least first and second types of LEDs and the plurality of LEDs on the back panel light engine comprise at least third and fourth types of LED, wherein the first, second, third and fourth types of LEDs emit different light spectrums.

2. A lighting apparatus according to claim 1 further comprising a controller operable to control intensity of the first, second, third and fourth types of LEDs independently such that the lighting apparatus is operable to change a mix of light spectrum output.

3. A lighting apparatus according to claim 1 further comprising a controller operable to control intensity of the first and second types of LEDs independently to the third and fourth types of LEDs such that the lighting apparatus is operable to change a mix of light spectrum output.

4. A lighting apparatus according to claim 1, wherein the first type of LED comprises a warm white LED, the second type of LED comprises a red LED, the third type of LED comprises a cool white LED and the fourth type of LED comprises a blue LED.

5. A lighting apparatus according to claim 1, wherein the back panel light engine is operable to emit light in substantially a first direction and the grid light engine is operable to emit light substantially in second, third, fourth and fifth directions.

6. A lighting apparatus according to claim 5, wherein the lighting apparatus is installed in a ceiling; and the first direction is downward and the second, third, fourth and fifth directions are angled directions downward in four different directions.

7. A lighting apparatus according to claim 1 further comprising an optics for scattering light emitted from the grid light engine and the back panel light engine without substantially changing the direction of the emitted light.

8. A lighting apparatus according to claim 7, wherein the optics comprises a fogging glass.

9. A lighting apparatus comprising:

a plurality of elongated segments interconnected perpendicularly to form a grid light engine, each segment comprising a plurality of groups of LEDs such that, when interconnected together, the grid light engine is operable to emit light inwardly to a plurality of grid squares formed by the segments;

a back panel light engine comprising a plurality of LEDs, the back panel light engine operable to emit light from its LEDs through the grid; and a controller operable to control intensity of at least two of the sides of the grid squares independently such that the grid light engine is operable to emit light differently in each of a plurality of directions.

10. A lighting apparatus according to claim 9, wherein the plurality of groups of LEDs on the segments comprise at least one first type of LED and the plurality of LEDs on the back panel light engine comprise at least one second type of LED, wherein the first and second types of LED emit different light spectrums.

11. A lighting apparatus according to claim 10, wherein a mix of the light spectrum emitted by the lighting apparatus on different locations local to the lighting apparatus is substantially different.

12. A lighting apparatus according to claim 10, wherein the controller is operable to control intensity of the first and second type of LEDs independently such that the lighting apparatus is operable to change a mix of light spectrum output.

13. A lighting apparatus according to claim 9, wherein the plurality of groups of LEDs on the segments comprise at least first and second types of LEDs and the plurality of LEDs on the back panel light engine comprise at least third and fourth types of LED, wherein the first, second, third and fourth types of LEDs emit different light spectrums.

14. A lighting apparatus according to claim 13, wherein the controller is operable to control intensity of the first, second, third and fourth types of LEDs independently such that the lighting apparatus is operable to change a mix of light spectrum output.

15. A lighting apparatus according to claim 13, wherein the controller is operable to control intensity of the first and second types of LEDs independently to the third and fourth types of LEDs such that the lighting apparatus is operable to change a mix of light spectrum output.

16. A lighting apparatus according to claim 13, wherein the first type of LED comprises a warm white LED, the second type of LED comprises a red LED, the third type of LED comprises a cool white LED and the fourth type of LED comprises a blue LED.

17. A lighting apparatus according to claim 9, wherein the back panel light engine is operable to emit light in substantially a first direction and the grid light engine is operable to emit light substantially in second, third, fourth and fifth directions.

18. A lighting apparatus according to claim 17, wherein the lighting apparatus is installed in a ceiling; and the first direction is downward and the second, third, fourth and fifth directions are angled directions downward in four different directions.

19. A lighting apparatus according to claim 9, wherein the controller is operable to control intensity of all four of the sides of the grid squares independently such that the grid light engine is operable to emit light differently in each of the four directions of the grid light engine.

20. A lighting apparatus according to claim 9 further comprising an optics for scattering light emitted from the grid light engine and the back panel light engine without substantially changing the direction of the emitted light.

* * * * *